United States Patent [19]

Tatyrek

[11] Patent Number: 4,760,833

[45] Date of Patent: Aug. 2, 1988

[54] ENGINE CRANKCASE VACUUM CHECK VALVE SYSTEM FOR INTERNAL COMBUSTION ENGINES

[76] Inventor: Alfred F. Tatyrek, 27 Orchard Rd., Maplewood, Essex County, N.J. 07040

[21] Appl. No.: 903,814

[22] Filed: Sep. 2, 1986

[51] Int. Cl.[4] ..... F02M 25/06

[52] U.S. Cl. ..... 123/574; 123/572

[58] Field of Search ..... 123/572, 574, 41.86, 123/90.38

[56] References Cited

U.S. PATENT DOCUMENTS

| | | | |
|---|---|---|---|
| 3,077,871 | 2/1963 | Daigh | 123/572 |
| 3,237,617 | 3/1966 | Daigh | 123/574 |
| 3,589,347 | 6/1971 | Sawada | 123/574 |

*Primary Examiner*—Willis R. Wolfe, Jr.
*Assistant Examiner*—M. Macy

[57] ABSTRACT

In a conventional internal combustion engine, an improved mechanism for removing blowby vapors from the crankcase to minimize the build up of sludge, gum, varnish and other contaminates that adversely affect engine performance. The improved mechanism operates in an essentially "sealed system" mode to maintain a usable vacuum force on the crankcase without a need for introducing atmospheric air into the system.

11 Claims, 6 Drawing Sheets

ENGINE CRANKCASE VACUUM CHECK VALVE SYSTEM FOR INTERNAL COMBUSTION ENGINES

GOVERNMENT INTEREST

Figure 1:
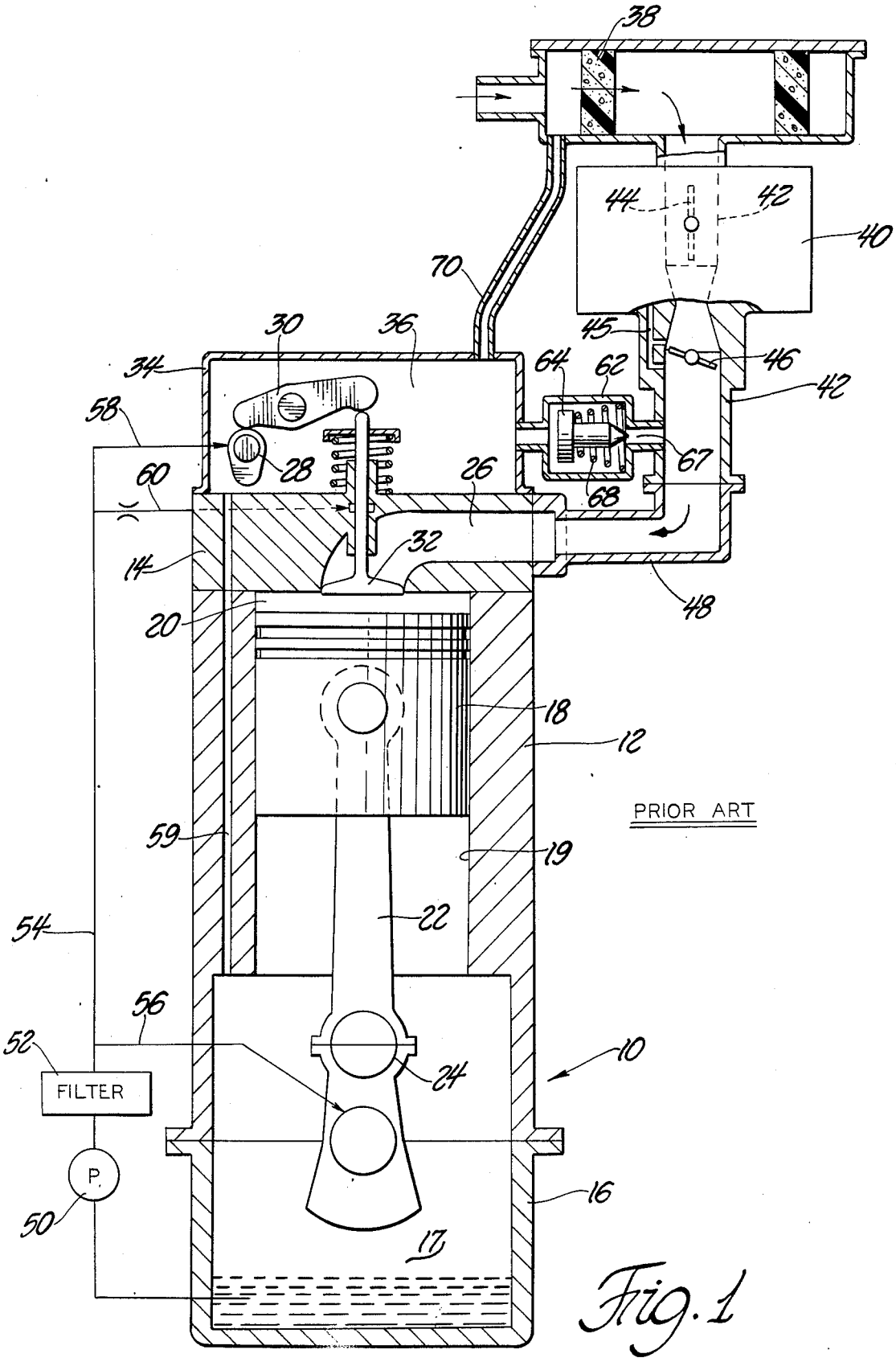

The invention described herein may be manufactured, used, and licensed by or for the Government for governmental purposes without payment to me of any royalty.

BACKGROUND AND SUMMARY OF THE INVENTION

This invention relates to mechanism for preventing the build-up of gaseous combustion products in the crankcase system of an internal combustion engine, and the removal of such combustion products before they can contaminate the engine oil, by the application of a vacuum force on the crankcase system. The mechanism serves to replace the conventional positive crankcase ventilation (PCV) system now in general use.

Prior to my invention, others have developed various mechanisms and fluid systems for removing blowby vapors from crankcase areas of internal combustion engines. The term "blowby vapors" herein refers to vapors developed during the combustion process that escape from the combustion chamber across the piston rings, rather than through the exhaust passage.

Such blowby vapors are undesired in that they can build up to produce a pressurized condition in the crankcase, leading to possible leakage of lubricant across the main (crankshaft) seals and/or through the gasket joint between the cylinder block and oil pan.

Such blowby vapors are also undesirable in the crankcase because they can react with the hot oil to form oxides and varnishes; in some cases a sludge build-up occurs as a result of condensation of blowby water vapor into the crankcase oil, especially in cooler engine oil. This interferes with oil flow and/or adversely affects the lubricant action of oil being circulated through the engine. In some cases, the blowby vapors containing unburned fuel act as a dilutant for the oil, thereby adversely affecting the oil film thickness on bearing surfaces.

In a known positive crankcase ventilation (PCV) system, a throttled flow of blowby vapors is drawn from the engine valve (rocker arm) chamber through a small passage leading to a point in the air induction duct downstream from the throttle valve. Vacuum force in the induction duct draws blowby vapors from the rocker arm chamber into the duct for assimilation with the air-fuel mixture being fed to the combustion chamber.

The blowby vapor flow is throttled or controlled by a spring-biased PCV valve in the aforementioned passage. The valve is arranged for movement toward or away from a metering orifice formed in the PCV valve housing. The spring urge the valve element toward an open position (away from the metering orifice) in opposition to the action of the vacuum force. At low manifold vacuum, a relatively high flow rate is achieved; at high manifold vacuum, the valve element is drawn into the metering orifice to reduce the flow rate.

A problem with the described system is adequate control of the blowby vapor flow rate. If a weak spring is used, the valve element will close at medium manifold vacuum force, thereby preventing any flow under high vacuum force conditions. If a strong spring is used, the valve element may remain open under high manifold vacuum conditions, thereby producing excessively high flow rates, resulting in a lean fuel/air mixture.

The conventional system employs an air intake passage from the engine air cleaner to the rocker arm chamber. Under high vacuum conditions, air flows from the air cleaner through the air intake passage into the rocker arm chamber, thereby relieving the vacuum force; the added air flow undesirably reduces the blowby vapor flow rate and also contributes to excessively lean fuel/air mixtures. Under superatmospheric and/or low vacuum conditions, blowby vapors may flow in reverse direction from the rocker arm chamber through the air intake passage into the air cleaner.

In tests performed on a worn engine equipped with the described system, I found that the vacuum produced in the rocker arm chamber was relatively low, less than four-tenth inches of mercury. I believe this relatively low vacuum force to be insufficient for proper venting of the blowby vapors, especially under high load, or high acceleration conditions, or on older worn engines, all situations where substantial quantities of blowby vapors are generated at a high rate.

The principal object of my invention is to provide a crankcase venting mechanism wherein substantial vacuum forces are maintained, e.g., one to fifteen inches of mercury.

Another object of my invention is to provide a crankcase venting mechanism wherein the high vacuum force is maintained within safe limits, i.e., below some predetermined value suitable to engine design.

A further object is to provide a crankcase venting mechanism that has a partially sealed character, whereby there is no normally open passage for introducing atmospheric air pressure into the crankcase mechanism.

As a result of maintaining a controlled vacuum on the crankcase and oil system, two significant benefits are achieved:

1. all engine oil leaks within the crankcase, valve cover, and timing cover are abated, which includes bearing seals, gaskets, hose connections and diaphrams, and 2. the crankcase oil is maintained in a cleaner condition because (a) blowby vapors are kept in a vapor state under the reduced pressure and are less likely to condense into and contaminate the engine and crankcase oil, (b) under reduced pressure the hot oil is less likely to oxidize to form undesired products, and (c) under reduced pressure the total concentration (per unit volume) of blowby vapors is proportionally reduced and consequently is less likely to condense in the engine and crankcase oil.

THE DRAWINGS

FIG. 1 illustrates an engine equipped with a positive crankcase ventilation (PCV) system build according to prior art techniques.

FIGS. 2, 4, 5 6 and 7 show an engine equipped with various different venting systems constructed according to my invention.

Figures 2, 3:
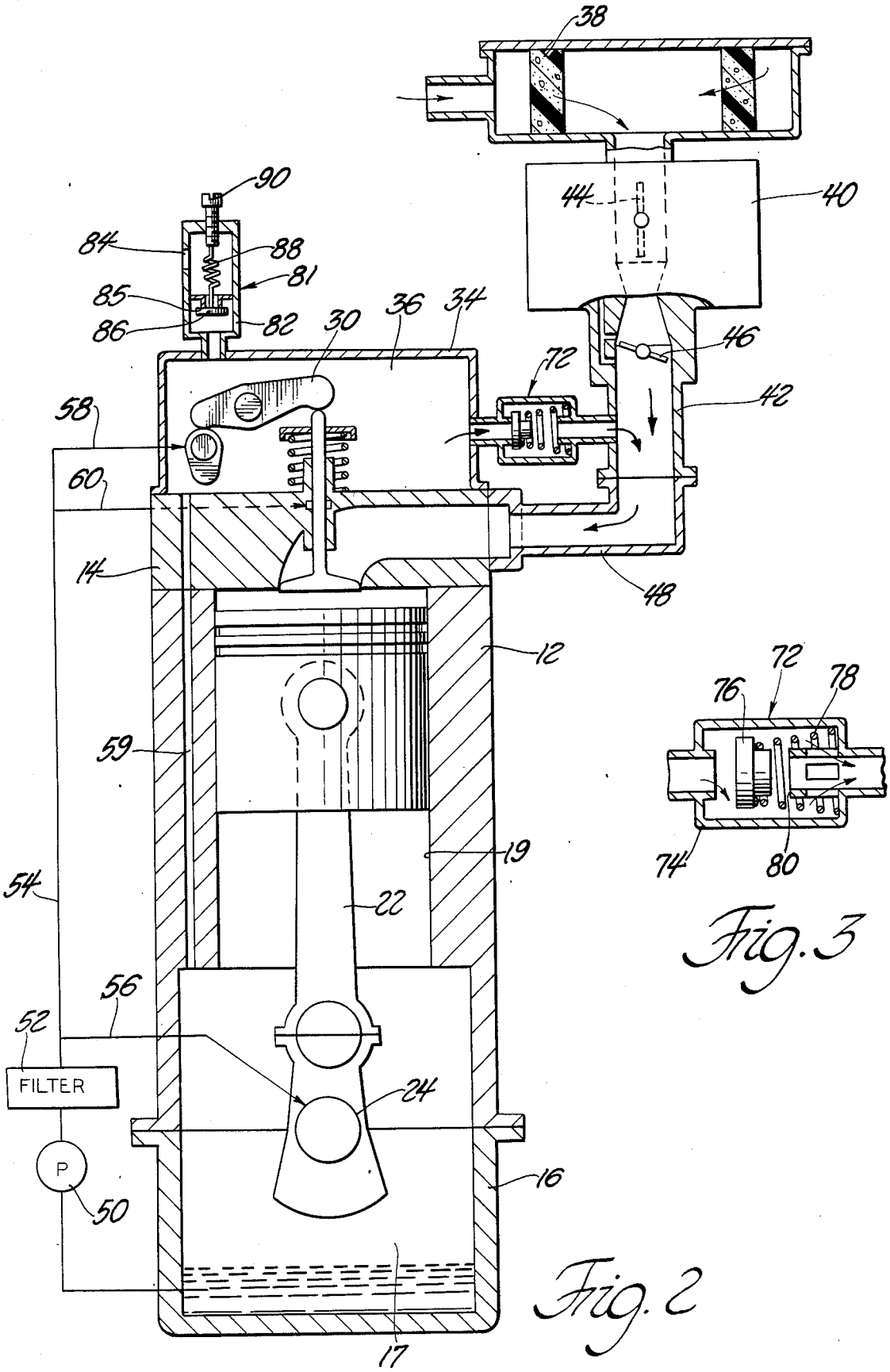

FIG. 3 is an enlarged view of a structural detail used in the systems shown in FIGS. 2, 4, 5 and 6.

PRIOR ART ARRANGEMENT

FIG. 1 illustrates some features of a conventional multi-cylinder engine 10 comprised of a cylinder block 12, cylinder head 14, and oil pan 16. Piston 18 is slidably disposed within block 12 for downward motion under explosive forces developed by a combustion process within chamber 20. The piston downstroke causes connecting rod 22 to produce rotary motion of crankshaft 24.

The combustive air-fuel mixture is introduced to chamber 20 through an intake passage 26 that contains a poppet valve 32. The usual rotary camshaft 28 is driven from the engine by a non-illustrated timing chain to impart rocking motion to an arm 30, whereby poppet valve 32 is opened in timed relation to the motion of piston 18. A cover structure 34 is suitably bolted to cylinder head 14 to define a sealed chamber 36 for confining lubricant used to lubricate camshaft 28, rocker arm 30 and intake valve 32.

FIG. 1 illustrates one cylinder of the engine, together with an associated intake valve and valve-operating mechanism. It will be understood that the complete engine includes a number of cylinders; each cylinder has the usual connecting rod, rocker arms and valves (one or more intake valves, plus one or more exhaust valves).

Air is supplied to the engine through an air cleaner 38 positioned atop a carburetor 40. The carburetor includes an air induction duct 42 containing a butterfly choke valve 44 and throttle valve 46. The downstream end of duct 42 connects to a conventional engine intake manifold 48 that is suitably branched to feed the air-fuel mixture to the various cylinder intake passages 26.

With the illustrated arrangement the liquid fuel is introduced into induction duct 42 through various ports 45. In the case of a fuel-injected engine, the fuel could be sprayed into the individual cylinders or into duct 42, via one or more fuel injector nozzles located downstream from throttle valve 46. Motion of piston 18 produces a vacuum force that draws the air-fuel mixture into each associated intake passage 26. The engine can be spark-ignited or compression-ignited.

ENGINE LUBRICATION

Conventional lubrication structures can be used. As shown, pump 50 draws liquid lubricant from crankcase 17. The liquid is pumped through a conventional oil filter 52 into a lubricant line 54. Branch lines 56, 58 and 60 distribute liquid lubricant to crankshaft 24 bearings, camshaft bearings 28 and the stem areas of poppet valves 32. Lubricant accumulating in chamber 36 drains back to crankcase 17 via one or more drain passages 59.

PRIOR ART CRANKCASE VENTILATION

During engine operation blowby vapors pass downwardly through the interface between piston 18 and cylinder bore 19, thereby producing a superatmospheric condition of higher pressure in crankcase 17 and the connected valve chamber 36. In the FIG. 1 prior art arrangement, blowby vapors are vented from chamber 36 into air induction duct 42 through a passage structure 62. The passage contains a floating valve element 64 and compression spring 68. Blowby vapors flow in a left-to-right direction around valve element 64 and through a metering orifice 67.

The vacuum existing in duct 42 tends to draw element 64 rightwardly to close metering orifice 67; spring 68 opposes rightward motion of valve element 64. At wide open throttle (when the vacuum force in duct 42 is low), valve element 64 is displaced away from orifice 67. As throttle 46 moves toward a closed position (idle and light load operation), the vacuum force in duct 42 tends to increase, thereby drawing valve element 64 toward metering orifice 67. The intention is to have a relatively high flow rate through passage 62 at wide open throttle, and a relatively low flow rate through passage 62 at the minimum throttle flow position. Intermediate flow rates through passage 62 are obtained when throttle 46 is in its intermediate (partly open) settings. The valve element in passage 62 is commonly known as the positive crankcase ventilation (PCV) valve.

The prior art system (FIG. 1) includes a second passage structure 70 between chamber 36 and air cleaner 38. Passage 70 serves to bring fresh air into the crankcase system to replace crankcase vapors removed by the force of vacuum through PCV valve 62, thus maintaining the crankcase under normal atmospheric pressure relative to the outside pressure. Passage 70 also acts as a pressure relief vent for built-up blowby gases. Passage 70 functions as a pressure relief device when chamber 36 is at superatmospheric pressure; during such periods gases (vapors) flow from chamber 36 through passage 70 into the air cleaner. Chamber 36 is pressurized when the build-up of vapors in chamber 36 exceeds the flow capability of passage structure 62; this is likely to occur when the vehicle is operating under high load (going up-hill and/or accelerating rapidly); when the engine is worn, the vapor build-up is likely to be even greater.

During most operating periods, vapor flow through passage 62 will produce a slight sub-atmospheric condition in chamber 36. At such times, passage 70 will flow some air from air cleaner 38 into chamber 36. The downflow of air through passage 70 is believed to be disadvantageous in that it (1) dilutes the blowby vapor flow and thus retards the vent action, (2) raises the absolute pressure in chamber 36, thus reducing the driving force that promotes flow through passage 62, and (3) contributes to excessively lean fuel/air ratios. In measurements that I made on one domestic automobile with a worn engine, I found chamber 36 to have only a very slight vacuum therein, less than 0.25 inches of mercury. I propose an arrangement wherein the vacuum force is considerably greater, e.g., one to fifteen inches of mercury.

FIG. 2 EMBODIMENT

FIG. 2 illustrates one form that my invention can take. Passage structure 62 and metering valve 64 (FIG. 1) are replaced by a check valve 72. As shown in FIG. 3, the check valve comprises a passage structure 74, floatable valve element 76, and compression spring 78. The valve includes an outlet tube having four rectangular slots therein permitting unthrottled flow in a left-to-right direction. Left end 80 of the outlet tube limits rightward motion of valve element 76.

The check valve 72 is intended to permit unthrottled one-way flow from chamber 36 to air induction duct 42. There is no metering orifice and cooperating metering element, as contemplated in the FIG. 1 prior art arrangement.

The arrangement of FIG. 2 is believed advantageous in that a relatively high vacuum force is developed in chamber 36, e.g., up to fifteen inches of mercury. Relatively high flow rates are developed in passage structure 74.

In order to control the vacuum force in chamber 36 at a safe value, the FIG. 2 arrangement includes a vacuum control valve 81. The control valve is designed to permit inflow of air from the atmosphere to chamber 36 when chamber 36 vacuum exceeds some predetermined value, e.g., fifteen inches of mercury. The control valve is intended to prevent excessively high vacuum forces from developing in chamber 36 (and crankcase 17) while otherwise sealing chamber 36 and crankcase 17 from the ambient atmosphere.

Control valve 81 is shown to include a housing 82 having an air entrance port 84 and valve seat 85. A disclike valve element 86 is suitably connected to one end of a tension spring 88. The other end of the spring connects with a tension-adjustment screw 90 that is threaded into a threaded opening in an end wall of housing 82.

When the vacuum in chamber 36 exceeds a predetermined value, it draws valve element 86 downwardly away from valve seat 85, thereby permitting ambient air to inflow through port 84, around element 86, and into chamber 36. This action prevents chamber 36 and chamber 17 from developing excessively high vacuum forces therein.

The FIG. 2 system has been found to be advantageous over the FIG. 1 system in that (1) it provides a means to totally eliminate all oil leaks in the crankcase system by reason of the reduced pressure in chambers 36 and 17 relative to the outside pressure, (2) it reduces the formation of sludge and other blowby ventilation in the crankcase by keeping the vapors in vapor form and from condensing into the oil, (3) the lower pressure and reduced concentration of air (oxygen) reduces the amount of oxidation taking place with the hot engine oil to form undesired products, and (4) there is a greater vacuum driving force promoting flow from chamber 36 into duct 42.

FIG. 4 EMBODIMENT

Figure 4:
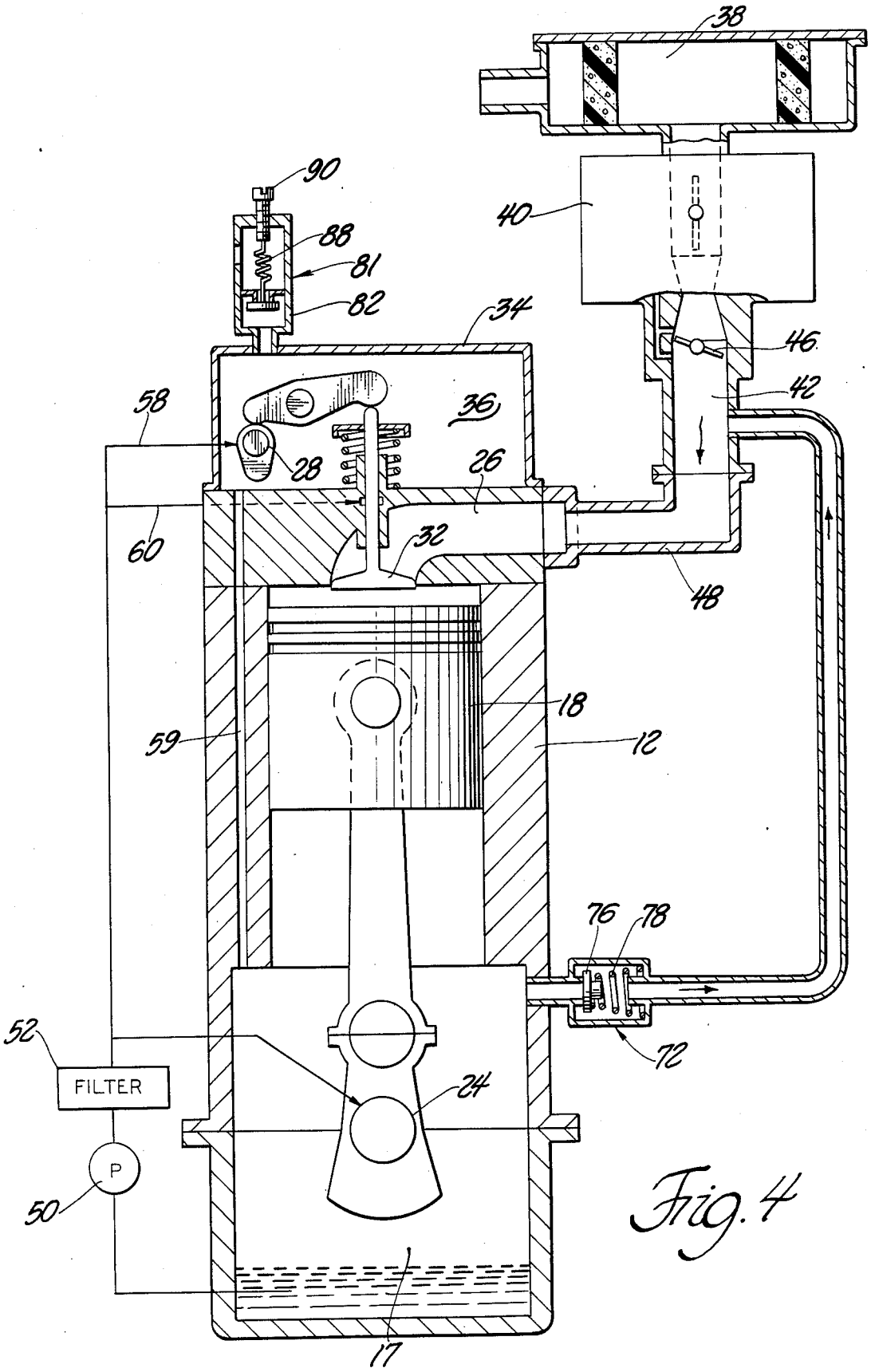

The FIG. 4 embodiment is functionally similar to the FIG. 2 embodiment. Both embodiments include an unthrottled flow check valve 72 and vacuum control valve 81. In the FIG. 4 embodiment, the check valve passage structure 74 forms a direct flow connection between crankcase 17 and air induction duct 42. In the FIG. 2 arrangement, crankcase 17 connects with the air induction duct through drain passage 59 and chamber 36.

FIG. 5 EMBODIMENT

Figure 5:
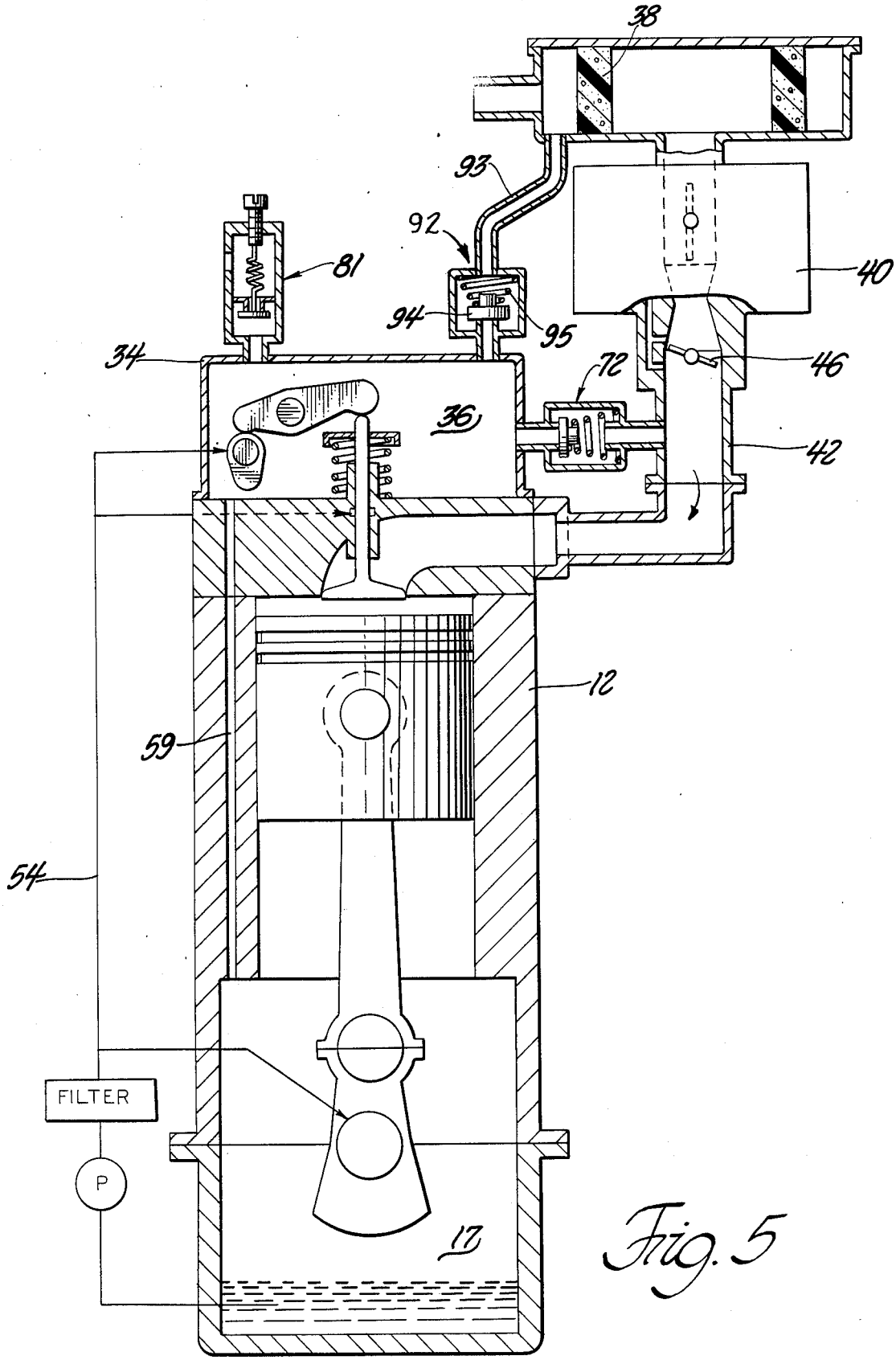

FIG. 5 illustrates a system that is similar to the FIG. 2 system, except for the addition of a check valve mechanism 92. The added mechanism includes a flow passage 93 between chamber 36 and air cleaner 38. Disposed within the passage is a floatable check valve element 94 and biasing spring 95. The check valve permits one-way flow from chamber 36 to the air cleaner; no flow is permitted in the other direction, i.e., from air cleaner 38 to chamber 36.

Check valve mechanism 92 is normally in a closed no-flow condition. However, should chamber 36 momentarily be at a superatmospheric pressure, the check valve will open, permitting the undesired pressure to be vented from chamber 36 into the air cleaner. Valve mechanism 92 would come into play, if at all, during intermittent periods when large volumes of blowby vapors are building up in the crankcase system.

FIG. 6 EMBODIMENT

Figure 6:
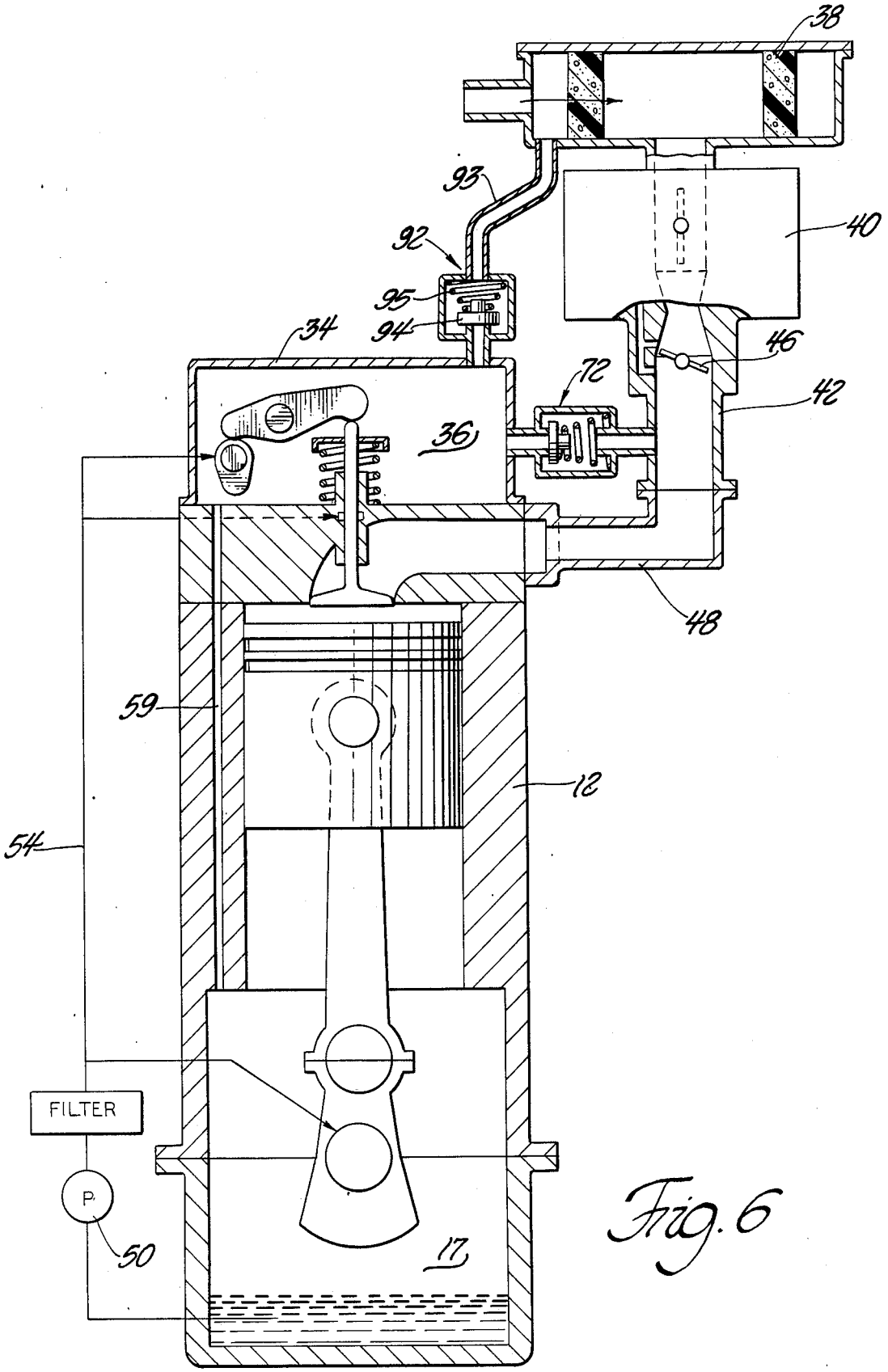

FIG. 6 illustrates a system that is similar to the FIG. 5 system except that it lacks the vacuum control valve 81. The FIG. 6 system permits unthrottled flow from chamber 36 into air induction duct 42; chamber 36 is at a relatively high vacuum for achievement of relatively large flow-driving forces. Valve mechanism 92 provides pressure relief for chamber 36 at times when blowby is excessive and vacuum flow is low, as in acceleration under load. The FIG. 6 system lacks the vacuum limit control feature achieved by the use of control valve 81.

A major advantage of the invention (FIGS. 2 through 6) is that it provides a sealed system. Thus, there is no two-way flow passage similar to passage 70 shown in FIG. 1. With my invention the vacuum forces are relatively high (e.g., up to fifteen inches of mercury). Blowby vapors are rapidly vented from the crankcase; at the same time any oil leaks in the crankcase (at the oil pan flange, in the timing cover, valve cover or main bearing seals) are effectively prevented.

FIG. 7 EMBODIMENT

Figure 7:
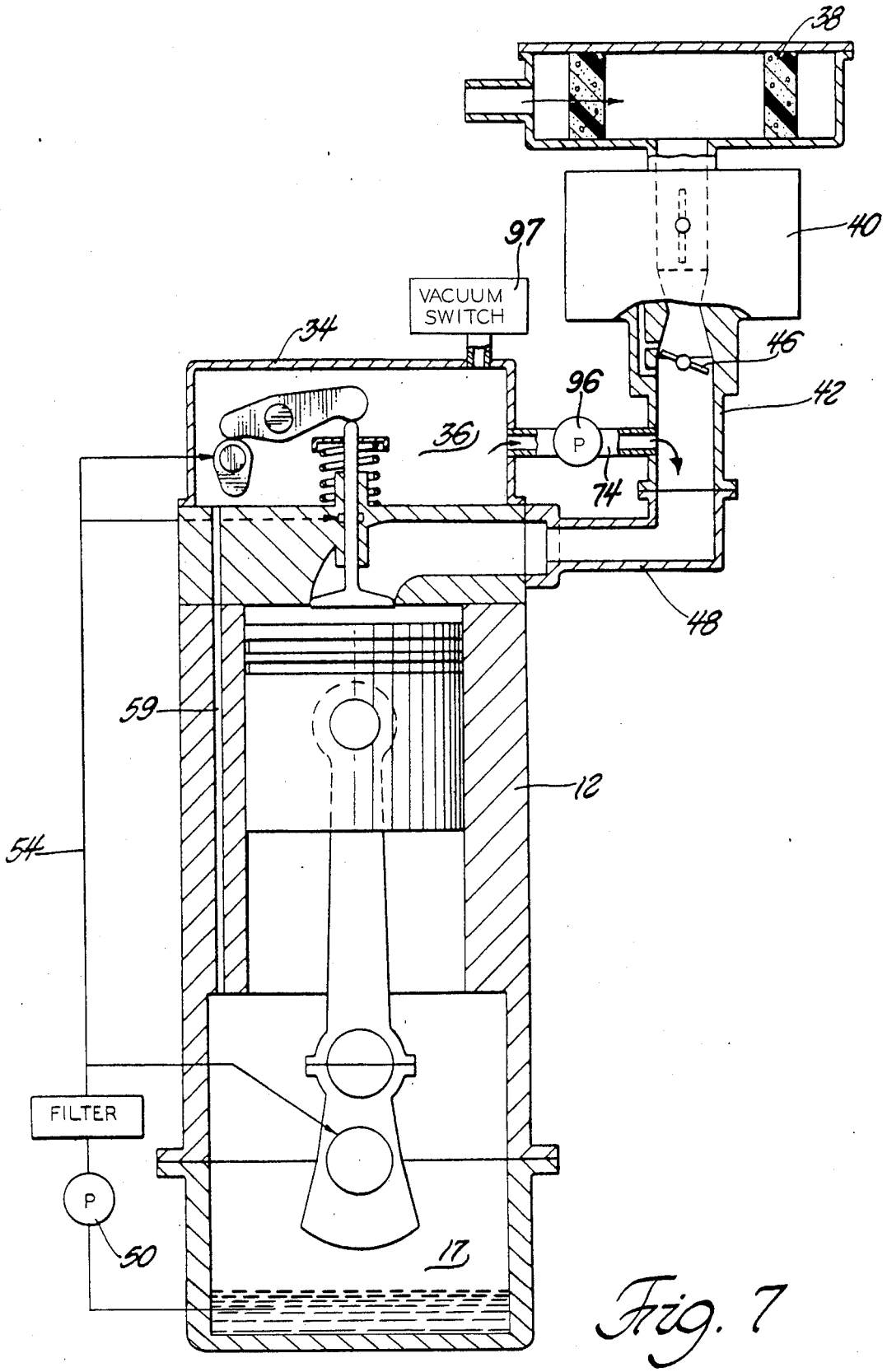

FIG. 7 illustrates a system wherein a vacuum pump 96 is arranged in passage 74 to move blowby vapors from chamber 36 into air induction duct 42. The pump can be powered by engine rotation or by a small electric motor (not shown) that is suitably wired to a vacuum responsive switch 97. The system is such that when the vacuum force in chamber 36 falls below a predetermined value, e.g., five inches of mercury, the pump goes on to restore the vacuum force; when the vacuum force rises above a predetermined value, e.g., ten inches of mercury, the pump goes off. Alternately the vacuum may also be controlled by a vacuum-control valve, as shown at 81 in the FIG. 2 embodiment. The system can be sized to maintain the vacuum force within a desired operating range under a variety of different engine load/speed conditions.

I wish it to be understood that I do not desire to be limited to the exact details of construction shown and described for obvious modifications will occur to a person skilled in the art, without departing from the spirit and scope of the appended claims.

I claim:

1. In a piston engine comprising a piston-cylinder means defining a combustion chamber, said piston and cylinder cooperatively defining a piston-cylinder interface, an air induction duct for supplying clean air to the combustion chamber in response to vacuum forces developed by reciprocable motion of the piston, a throttle valve operable to vary the vacuum force in the air induction duct, valve means operated in timed relation to the piston to control air flow into the combustion chamber, a crankcase containing liquid lubricant for the engine, said crankcase being in continuous open communication with the piston whereby blowby vapors can pass from the combustion chamber through said piston-cylinder interface to contaminate the crankcase lubricant:

The improvement comprising means for maintaining a substantially continuous vacuum force on said crankcase measuring at least one inch of Mercury, said vacuum-maintaining means comprising means for venting the crankcase to remove blowby vapors therefrom; said venting means including a passage means interconnecting the crankcase and a point in the air induction duct downstream from the aforementioned throttle valve, a check valve in said passage means permitting unthrottled flow of vapors from the crankcase to the air induction duct while preventing reverse flow from the air induction duct to the crankcase;

and a normally continuously closed vacuum relief valve permitting inflow of air from ambient atmosphere to the crankcase only when the vacuum therein exceeds a predetermined value greater than one inch of Mercury, said normally continuously closed vacuum relief valve being operable to prevent excessively high vacuum forces from developing in the crankcase while otherwise sealing said crankcase against crankcase oil leakage to the ambient atmosphere.

2. In a piston engine comprising a piston-cylinder means defining a combustion chamber, said piston and cylinder cooperatively defining a piston-cylinder interface, an air cleaner, an air induction duct connected to the air cleaner for supplying clean air to the combustion chamber in response to vacuum forces developed by reciprocable motion of the piston, a throttle valve operable to vary the vacuum force in the air induction duct, valve means operated in timed relation to the piston to control air flow into the combustion chamber, a crankcase containing liquid lubricant for the engine, said crankcase being in continuous open communication with the piston whereby blowby vapors can pass from the combustion chamber through said piston-cylinder interface to contaminate the crankcase lubricant:

the improvement comprising means for maintaining a substantially continuous vacuum force on said crankcase measuring at least one inch of Mercury, said vacuum-maintaining means comprising means for venting the crankcase too remove blowby vapors therefrom; said venting means including a chamber structure for the aforementioned valve means, the defined valve chamber being in open communication with the crankcase; a first conduit interconnecting the valve chamber and a point in the air induction duct downstream from the aforementioned throttle valve, a first check valve in said first conduit operable to permit unthrottled flow of vapors from the valve chamber to the air induction while preventing reverse flow from the iar induction duct to the valve chamber; a second conduit interconnecting the valve chamber and the air cleaner, and a second check valve in said second conduit operable too permit unthrottled flow of pressurized blowby vapors from the valve chamber to the air cleaner while preventing reverse flow from the air cleaner to the valve chamber; said valve chamber being sealed during normal engine operation whereby the entire flow through the valve chamber is constituted by vapors accumulated in the crankcase.

3. The improvement of claim 2 and further comprising a normally closed vacuum relief valve connected to the valve chamber, said control valve permitting inflow of air from ambient atmosphere to the valve chamber only when the vacuum in said valve chamber exceeds a predetermined value greater than one inch of Mercury; said normally closed vacuum relief valve being operable to prevent excessively high vacuum forces from developing in the valve chamber while otherwise sealing said valve chamber from ambient atmosphere.

4. In a piston engine having a piston-cylinder interface, an air induction duct, and a crankcase susceptible to receiving blowby vapors from said piston-cylinder interface: the improvement comprising means for maintaining a substantially continuous vacuum force on said crankcase measuring at least one inch of Mercury, said vacuum-maintaining means comprising means for venting blowby gases from the crankcase into the air induction duct; said venting means including a check valve permitting unthrottled one-way flow from the crankcase to the air induction duct, a normally continuously closed vacuum relief valve permitting inflow of ambient air to the crankcase only when crankcase vacuum exceeds a predetermined value greater than one inch of Mercury, and a pressure-relief valve permitting one way outflow of air from said crankcase.

5. In a piston engine comprising a piston-cylinder means defining a combustion chamber, said piston and cylinder cooperatively defining a piston-cylinder interface, an air induction duct for supplying clean air to the combustion chamber in response to vacuum forces developed by reciprocable motion of the piston, a throttle valve operable to vary the vacuum force in the iar induction duct, valve means operated in timed relation to the piston to control air flow into the combustion chamber, a crankcase containing liquid lubricant for the engine, said crankcase being in continuous open communication with the piston whereby blowby vapors can pass from the combustion chamber through said piston-cylinder interface to contaminate the crankcase lubricant:

the improvement comprising means for maintaining a substantially continuous vacuum force on said crankcase measuring at least one inch of Mercury, said vacuum-maintaining means comprising means for venting the crankcase to remove blowby vapors therefrom; said venting means including a passage means interconnecting the crankcase and a point in the air induction duct downstream from the aforementioned throttle valve, and means establishing sufficient flow through the passage means such that the crankcase is continuously under a vacuum of at least one inch of Mercury, said venting means including vacuum relief means to avert engine damage operable to prevent vacuum forces above a predetermined value from developing in the crankcase while otherwise sealing said crankcase from the ambient atmosphere.

6. The improvement of claim 5 wherein the flow-establishing means comprises a vacuum pump in the passage means and a vacuum switch responsive to crankcase pressure to control the pump.

7. The improvement of claim 5 wherein the flow-establishing means comprises a check valve in said passage means permitting unthrottled flow of vapors from the crankcase to the air induction duct while preventing reverse flow from the air induction duct to the crankcase; and a vacuum control valve permitting inflow of air from the ambient atmosphere to the crankcase only when the vacuum therein exceeds a predetermined value greater than one inch of Mercury; said vacuum control valve being operable to prevent excessively high vacuum forces from developing in the crankcase while otherwise sealing said crankcase from the ambient atmosphere.

8. In a conventional internal combustion engine having an air induction duct and a crankcase: the improvemnt comprising a vacuum-producing mechanism for transferring blowby vapors from the crankcase to the engine air induction duct, to thereby minimize the build up of contaminates that adversely affect engine performance; said vacuum-producing mechanism operating in an essentially sealed-system mode to maintain a significant vacuum force of at least one inch of Mercury on the crankcase without need for introducing atmospheric air into the system; said vacuum-producing mechanism including means for maintaining the vacuum between upper and lower limiting values and for maintaining volatile contaminants in the crankcase in vapor form, whereby said contaminants are prevented from condensing to the liquid state so as to contaminate the engine and engine oil.

9. The improvement of claim 8 whereby the mechanism comprises a vacuum pump operable to pump vapors from the crankcase to the engine air induction duct.

10. The improvement of claim 8 wherein the mechanism comprises a check valve permitting unthrottled one-way flow from the crankcase to the engine air induction duct, and a vacuum control valve permitting inflow of air from atmosphere to said crankcase only when the vacuum therein exceeds a predetermined value greater than one inch of Mercury.

11. The improvement of claim 8 wherein the vacuum-producing mechanism comprises a vacuum control valve permitting inflow of air from the ambient atmosphere to the crankcase only when the vacuum therein exceeds a value of approxiamtely fifteen inches of Mercury.

* * * * *